United States Patent [19]

Luckenbill

[11] 4,083,377

[45] Apr. 11, 1978

[54] FIRE HYDRANT WITH IMPROVED WEATHER CAP AND BONNET ARRANGEMENT

[75] Inventor: Lawrence F. Luckenbill, Decatur, Ill.

[73] Assignee: Mueller Co., Decatur, Ill.

[21] Appl. No.: 733,853

[22] Filed: Oct. 19, 1976

[51] Int. Cl.[2] ..... F16K 27/12

[52] U.S. Cl. ..... 137/296; 137/377

[58] Field of Search ..... 137/272, 280–308, 137/377, 382; 251/355

[56] References Cited

U.S. PATENT DOCUMENTS

| | | | |
|---|---|---|---|
| Re. 16,168 | 9/1925 | Charland | 137/272 |
| 208,072 | 8/1878 | Carr | 137/285 |
| 1,619,748 | 3/1927 | Muend | 137/382 X |
| 2,018,454 | 10/1935 | Lofton | 137/298 |
| 2,020,181 | 11/1935 | Hayner | 137/290 |
| 2,078,782 | 4/1937 | Storey | 137/294 X |
| 2,088,426 | 7/1937 | Lofton | 137/289 |
| 2,576,631 | 11/1951 | Mueller et al. | 251/355 |
| 3,534,941 | 10/1970 | Dunton | 137/296 X |

*Primary Examiner*—Martin P. Schwadron
*Assistant Examiner*—Richard Gerard
*Attorney, Agent, or Firm*—Cushman, Darby & Cushman

[57] ABSTRACT

A fire hydrant comprising a barrel member having an open upper end with an apertured type closure member detachably secured thereto, the apertured top closure member including a generally flat plate portion and a downwardly extending annular portion. The top closure member is secured to the barrel member by bolt means arcuately spaced therearound and the closure member together with the operating nut define a lubricant reservoir for lubricating the hydrant valve stem and cooperating operating nut. A hold-down nut received in the apertured top closure member holds the operating nut relative to the closure member for rotation and an inverted dish-shaped weather cap is threadedly received on the hold-down nut to protect the bolt means holding the closure member on the barrel as well as to protect the access means for the lubricant reservoir. The arrangement of the upper portion of the fire hydrant is such that components thereof may be used interchangeably as modules with different shaped barrel assemblies and yet the overall hydrant configuration will have a flat modern appearance due to the dish-shaped weather cap.

14 Claims, 5 Drawing Figures

FIRE HYDRANT WITH IMPROVED WEATHER CAP AND BONNET ARRANGEMENT

The present invention relates to an improvement in fire hydrants and more particularly to the upper portion of the fire hydrant which includes improved components for the lubricant reservoir for the valve stem and the operating nut, the hold-down nut of the operating nut, and the weather cap for protecting the bolt retaining means for the closure member as well as the access means for the lubricant reservoir.

BACKGROUND OF THE INVENTION

In the past, the upper portion of fire hydrants has been provided with top closure members bolted to the open upper end of the hydrant barrel, the top closure members' caps being provided for closing the upper end of the hydrant barrel and for providing a lubricant reservoir for lubricating the cooperating threads between the upper end of the hydrant valve stem and the operating nut. While such hydrant arrangements have included access means to the lubricant reservoir and have further included weather caps to protect the same, the weather caps were usually secured to and rotated with the operating nut and did not normally protect both the bolt means for retaining the closure member on the barrel and the access means for the lubricant reservoir. Additionally, such prior art arrangements required a complex removal procedure of first removing the operating nut and then the weather cap in order to get to the access means for the lubricant reservoir and they did not provide a non-rotatable weather cap forming a partially sealed section external to the pressure area of the hydrant which could be easily removed without affecting the operating nut.

Where installations were provided with weather caps which were not part of the operating nut or did not rotate with the operating nut, they still were held on by the operating nut and it thus required removal of both the operating nut and the weather cap to have access either to the bolt means holding the closure member on the barrel or to the access means for the lubricant reservoir. A seal had to be made between the operating nut and the weather cap otherwise it did not completely provide the function of protection for the bolt means and the access means to the lubricant reservoir.

PRIOR ART

The following patents represent prior art arrangements providing weather caps for fire hydrants:

| NUMBER | NAME | DATE |
|---|---|---|
| Re. 16,168 | CHARLAND | Sept. 15, 1925 |
| 208,072 | CARR | Sept. 17, 1878 |
| 2,020,181 | HAYNER | Nov. 5, 1935 |
| 2,078,782 | STOREY | April 27, 1937 |
| 2,088,426 | LOFTON | July 27, 1937 |
| 2,576,631 | MUELLER ET AL. | Nov. 27, 1951 |

BRIEF SUMMARY OF THE INVENTION

The present invention relates to an improvement in a fire hydrant comprising a barrel member having an open upper end, valve means positioned in the lower portion of the barrel member, a reciprocating valve stem extending from the valve means upwardly within the barrel member and means operatively engaging the valve stem and the barrel member for restraining the valve stem from rotation while permitting reciprocating movement of the same. The open upper end of the barrel member is closed by an apertured top closure member detachably secured thereto by bolt means arcuately spaced about the closure member, the closure member having the aperture therethrough provided with an inwardly extending shoulder. The flat plate portion of the closure member is of a diameter great enough to fit over the upper end of the barrel member and is provided with a downwardly extending annular portion fitting into the barrel member and a downwardly extending tubular portion through which the upper end of the valve stem extends. A rotatable operating nut member projects out of the top closure member and it has an exterior flange thereon which operatively abuts the shoulder in the aperture of the top closure member. Cooperating thread means are provided on the operating nut member and the upper end of the valve stem so that when the nut member is rotated the valve stem is raised or lowered. A tubular hold-down nut extending out of the closure member is threaded to the closure member and it abuts the flange of the operating nut to hold it in place. A lubricant reservoir defined between the operating nut and the tubular portion of the closure member is provided with a passage to the exterior through the closure member, the passage being closed by a removable plug. A weather cap is threaded onto the portion of the hold-down nut extending out of the top closure member, the weather cap being dish-shaped and inverted and of a diameter to protect the bolt means and the removable plug for the lubricant reservoir.

The weather cap is provided with arcuately spaced lugs extending outwardly of the same which may receive a suitable tool such as a spanner or the like for either threading the cap on or off of the hold-down nut.

Sealing means are provided between the operating nut and the hold-down nut and between the hold-down nut and the top closure member as well as between the annular portion of the closure member and the inside of the upper end of the hydrant barrel. Additionally, sealing means are provided between the valve stem and the downwardly extending tubular portion for providing a seal between the interior of the barrel and the lubricant reservoir.

The operating nut may be a two-piece member pinned together, and the means for preventing rotation of the valve stem but permitting reciprocation thereof may be located in either the upper portion of the hydrant in the lubricant reservoir or may be located in the lower portion of the hydrant barrel adjacent the hydrant valve.

The hydrant may include an operating nut which extends out of the closure member's downwardly extending tubular portion and the tubular portion may be provided with an annular bushing having a sealing means on its interior for sealing between the same and the portion of the operating nut extending out of the downwardly extending tubular portion of the closure member.

While the hydrant of the present invention includes an improved upper section having components which define module that may be interchanged with other shaped barrel assemblies, it does provide for complete protection of the bolt means for bolting the same to the upper end of the hydrant barrel and for the access means to the lubricant reservoir. The module including weather cap for the upper hydrant section components gives the hydrant a flat modern appearance regardless of the type of barrel used and provides for easy servicing of the hydrant.

DETAILED DESCRIPTION OF THE INVENTION

Figure 1:
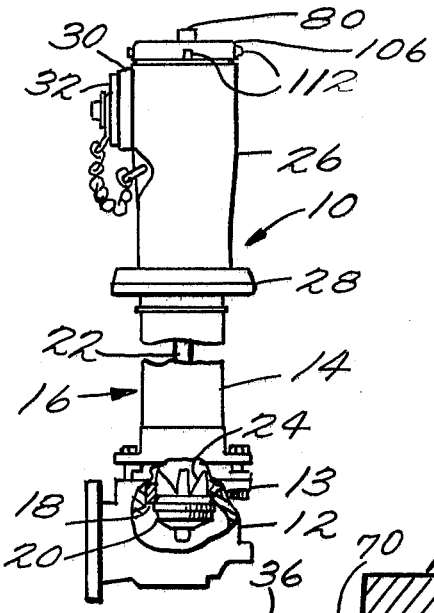
FIG. 1 is a side-elevational view partly in cross-section disclosing the improved fire hydrant of the present invention.

Referring now to the drawings wherein like character or reference numerals represent like or similar parts, the fire hydrant of the present invention as shown in FIG. 1, is identified generally by the numeral 10 and it is adapted to be connected to a water main (not shown). The hydrant 10 includes a hydrant barrel member 16 comprising a shoe 12 having an upwardly opening mouth surrounded by a peripheral flange 13, a lower barrel section 14 and an upper barrel section 26. The flange 13 of the shoe 12 is detachably bolted to the lower end of the lower barrel section 14 and further, the shoe 10 is provided with a brass seat ring 18 threaded into its open mouth, the brass seat ring 18 having a downwardly facing frusto-conical seat for seating with a reciprocating valve element 20.

The valve element 20 is provided with an upwardly extending valve stem 22 and with upwardly extending rib elements 24 which cooperate with longitudinally extending grooves in the seat ring 18. As is now evident, the ribs 24 prevent the valve element 20 as well as the upwardly extending valve stem 22 from rotating, but such ribs permit the valve element and valve stem to reciprocate vertically.

The upper barrel section 26 of barrel member 16 has its lower end connected to the upper end of the lower barrel section 14 by means of any suitable frangible flange connection 28. The upper barrel section 26 is provided with the usual hydrant nozzles 30, each having closures 32 detachably carried thereon. The fire hydrant 10 of the present invention is commonly referred to as a "dry barrel" hydrant since the main hydrant valve element is located in the shoe 12 and not at the hydrant nozzles 30. Such a hydrant 10 is utilized in areas where there is a possibility of a freeze and thus the hydrant is protected at all times since the lower barrel section 15 is buried in the ground with the main hydrant valve 20 positioned well below the freeze line.

Figure 2:
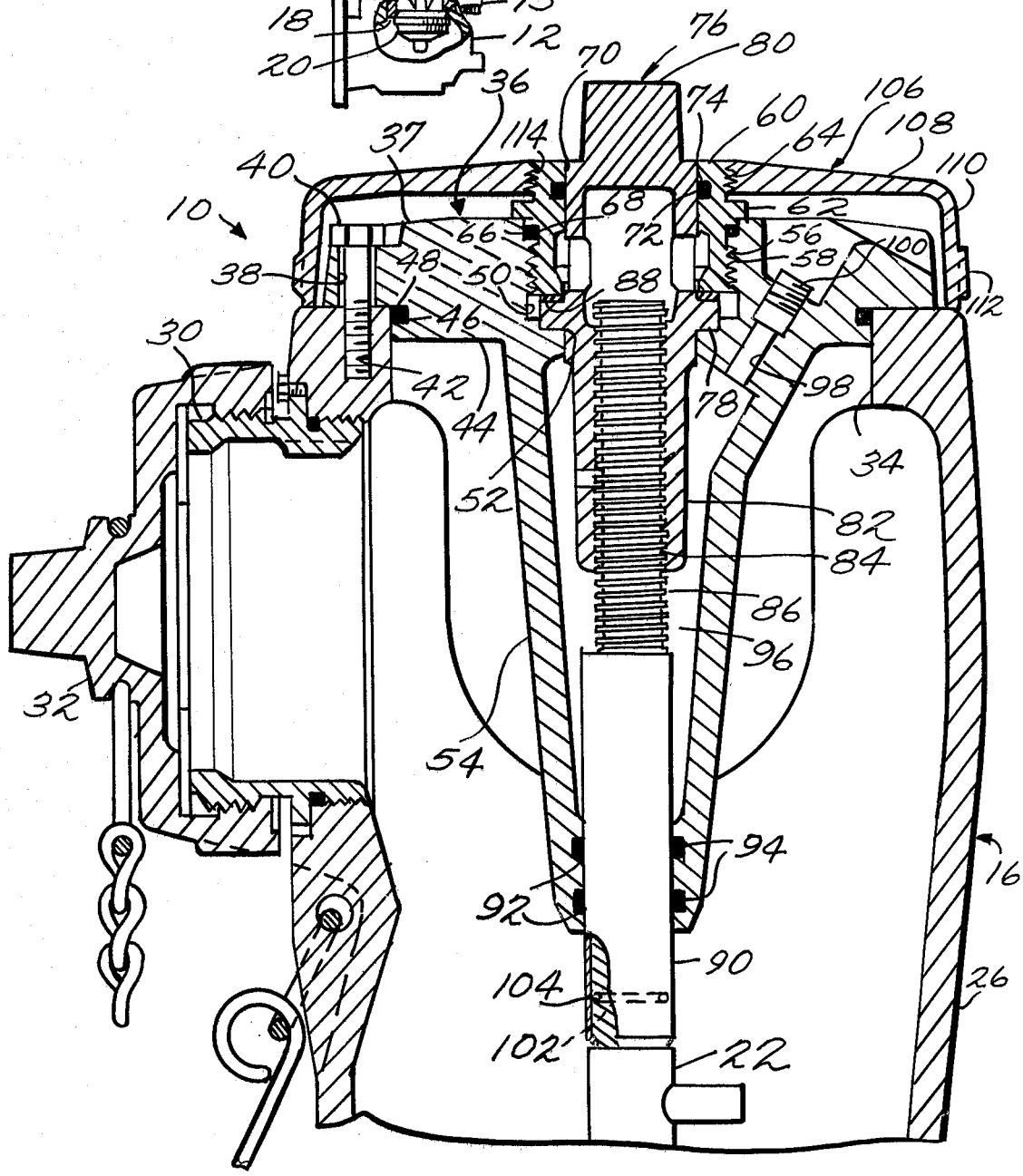
FIG. 2 is an enlarged-vertical sectional view through the upper portion of the hydrant of FIG. 1 and illustrating the various components of the module for upper hydrant section.

Referring now in detail to FIG. 2, it will be noted that the upper barrel section 26 of the barrel member 16 is provided with an open upper end 34. The open upper end 34 of the barrel member 16 is closed by a detachable top closure member 26, the closure member having a plurality of arcuately spaced bolt holes 38 extending about its periphery for receiving bolts 40 that extend into tapped holes 42 in the upper end 34 of the barrel member 16.

The top closure member 36, which has a generally flat plate portion 37 of a diameter great enough to fit on the upper end of the upper barrel section 26, is provided with an inwardly or downwardly extending annular shoulder 44 having a maximum diameter great enough to fit into the open upper end 34 of the barrel member. A groove 46 is provided about the periphery of the annular shoulder member and receives a sealing ring 48, such as an O-ring, for making a seal with the interior wall of the open upper end 34 of the upper barrel section 26 of the barrel member 16. By providing the seal 48 on the annular shoulder 44, the bolt means 40 can be utilized to tighten the closure member 36 on the upper end of the barrel member 16 as it is not necessary to so tighten the bolts with a predetermined torque so as to apply a uniform load should a gasket be placed between the interface of the upper end of the barrel 16 and the top closure member 36.

The top closure member 36 has an aperture 50 extending therethrough, the aperture being provided with an inwardly extending upwardly facing shoulder 52. Further, the top closure member 36 has a downwardly extending tubular portion 54, the tubular portion extending from the lower surface of the downwardly extending annular portion 44. The tubular portion extends in axial alignment with and forms a part of the aperture 50 through the top closure member 36.

The upper portion of the aperture 50 above the inwardly extending shoulder 52 is threaded as indicated at 56 for receiving the reduced threaded end 58 of a tubular hold-down nut 60. In more detail, the tubular hold-down nut 60 is provided with an annular outwardly extending flange 62 which is non-circular, such as a hexagon or the like, for receiving a wrench. The portion of the hold-down nut 60 extending outwardly of the flange 62 is exteriorly threaded as indicated at 64. A peripheral groove 66 is provided between the hold-down nut 60 and the closure member 36 above the threads 56 and 58 and below the flange 62, the groove receiving a sealing ring 68 such as an O-ring or the like. An aperture or bore 70 extending through the hold-down nut 60 is provided with an annular groove 72 for receiving a sealing ring 74 such as an O-ring, the sealing ring making a seal between the hold-down nut 60 and a rotatable operating nut 76.

The operating nut 76 includes an exterior flange 78 which is arranged to abut the upwardly facing inwardly extending shoulder 52 of the closure member 36 and a portion 80 which extends out of the closure member 36 and is provided with a non-circular cross-section for receiving a wrench to rotate the same. The portion 82 of the operating nut 76 below the shoulder 78 is provided with interior threads 84 for receiving the exterior threads 86 on the upper end portion of the valve stem 22. Hold-down nut 60 when threaded into the closure member 36 retains the operating nut 76 against axial movement but permits the operating nut 76 to be rotated. An anti-wear washer 88 may be interposed between the hold-down nut 60 and the flange 78 on the operating nut 76 so that the operating nut may be rotated easily by application of a wrench to its portion 80.

The portion of the upper end of the valve stem 22 below the lower extremity of its threads 86 extends downwardly and is outwardly of the tubular portion 54 of the closure member 36 and is of reduced cross-sectional diameter with respect to the lower portion of the valve stem, this portion being provided with a brass sleeve 90 around the same. It will be noted that the wall of the tubular portion 54 in the area where the sleeve 90 extends through the same is provided with annular grooves 92 for receiving sealing rings 94 such as O-rings. By providing the sealing rings 92 as shown in FIG. 2, a lubricant reservoir 96 is formed between the operating nut 76 and the tubular portion 54 and the lubricant reservoir 96 can be supplied with lubricant through a passageway 98 in the closure member 36, the passageway normally being closed by a threaded plug 100. Lubricant supplied to the lubricant reservoir 96, lubricates the threads 84 and 86 of the operating nut 76 and valve stem 22 respectively. In order that there can be no leakage of water between the sleeve 90 and the portion of the valve stem 22 which it surrounds, the valve stem is provided with an annular groove 102 for receiving a further sealing ring 104, such as an O-ring.

To protect the closure member 36 and particularly the bolts 40 and the plug 100 from weather, dirt or the like, a shallow inverted dish-shaped weather cap 106 is provided. The weather cap 106 includes a generally flat annular plate portion 108 having a downwardly extending annular skirt 110 about its periphery, the skirt 110 being provided with outwardly extending arcuately spaced lugs 112 for receiving a spanner or the like. A center aperture 114 is provided in the plate portion 108 of the cap 106, the aperture being provided with threads for cooperating with the threads 64 of the hold-down nut 60. When the weather cap 106 is threaded onto the hold-down nut 60 and it covers the bolts 40 and the plug 100, it does not rotate when the operating nut 76 is rotated. However, if it is necessary to replenish the lubricant in the lubricant chamber 96, the hold-down nut 60 does not have to be removed as it is merely necessary to apply a spanner to the lugs 112 and then rotate the weather cap 106 off of the hold-down nut 60 thus fully exposing the plug 100 so that it in turn may be removed and lubricant supplied to the lubricant reservoir 96. Likewise the entire module including the closure member 36, the hold-down nut 60 and the operating nut 76 may be removed as a unit by simply removing the weather cap 106 and then removing the bolts 40 and rotating the operating nut 76 to back the same off of the threaded upper end of the valve stem 22. This will result in the entire unit being bodily removed from the hydrant barrel member 16 as the closure member 36 and the hold-down nut 60 will move axially with the operating nut as it is rotated.

The module including the weather cap 106 may be used with any shape barrel member 16 that has an open upper end 34. Since the closure member 36 includes a generally flat plate portion 37 and the weather cap 106 can be made as a rather shallow dish-shaped member, the module gives the hydrant a flat modern appearance regardless of barrel shape or configuration.

Figure 3:
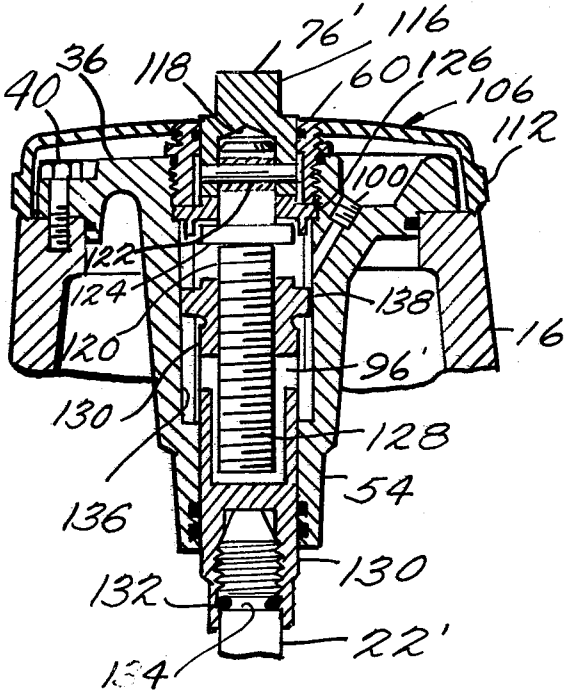
FIG. 3 is a vertical sectional view similar to FIG. 2 but on a reduced scale and illustrating upper section components of a modified module wherein the hold-down nut is a two-piece member.

Referring now to FIG. 3, there is disclosed a modified module for closing the upper open end of a hydrant barrel 22 and its upper section components which are identical or substantially similar to those of the module shown in FIGS. 1 and 2 will be given the same numerals. In the module of FIG. 3, the operating nut 76' is made in two pieces, namely, an upper portion 116 projecting through and out of the hold-down nut 60, the upper portion 116 having a downwardly opening closed bottom bore 118 which receives the upper end of a lower portion 120. A drive pin 122 extending radially through the upper portion 116 and the lower portion 120 retains the two portions together and functions as a driving means between the two portions. The lower portion 120 is provided with an exterior flange 124 and positioned between the flange 124 and the upper portion 116 is a thrust bushing 126 which abuts the shoulder 52 in the aperture of the closure member 36. Of course, the hold-down nut 60 also abuts the thrust bushing 126 so that the operating nut 76' is restrained axially but can rotate. The lower portion is provided with exterior threads 128 beneath the flange 124 which cooperate with the interior threads of an operating screw 130 which form the upper portion of the valve stem 22'. The operating screw 130 is threaded onto the upper end of the valve stem 22' and a sealing ring 132 is provided in a groove 134 on the valve stem 22' to protect the threads of the operating screw 130 and of the valve stem. The operating screw which extends downwardly and out of the tubular portion 54 of the closure member 36 reciprocates with respect to the closure member 36 as the wall of the lubricant chamber 96' is provided with longitudinally extending grooves 136 which receive ears 138 on the operating screw 130.

It will be evident that when the operating nut 76' is rotated it in turn will rotate its lower portion 120 which will cause the operating screw 130 to reciprocate with its ears 138 riding in the grooves 136 in the interior wall of the downwardly extending tubular portion 54 of the closure member 36. The module shown in FIG. 3 is provided with a weather cap 106 which is identical to the weather cap described with respect to FIG. 2 and this weather cap is threaded onto the upper threads of the hold-down nut 60.

Figure 4:
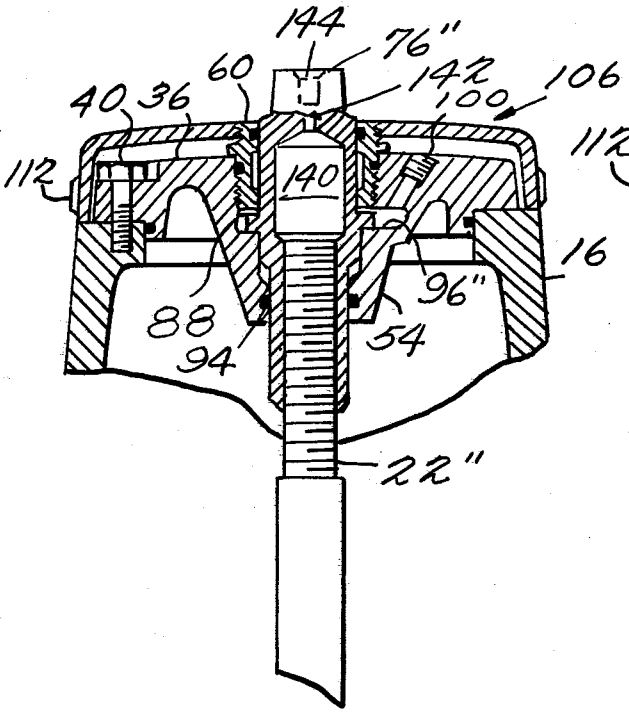
FIG. 4 is a vertical sectional view also similar to FIG. 2 but again illustrating a slightly modified version of the module wherein the hold-down nut extends downwardly and outwardly of the top closure member.

Referring now to FIG. 4 there is disclosed a module somewhat similar to the module of FIG. 2 except that the operating nut 76'' extends down and out of the tubular portion 54 of the closure member 36. In this arrangement there are two lubricant reservoirs, the first being a reservoir 96'' defined between the tubular portion 54 and the operating nut 76''. Since the operating nut 76'' is provided with a chamber or closed bottom bore 140 above the upper end of the valve stem 22'' for receiving the same, a passage 142 extends through the operating nut to the exterior and this passage is closed by a plug 144. The chamber 140 thus defines a second reservoir for providing lubricant to the threads between the valve stem 22'' and the operating nut 76'', whereas the first lubricant reservoir 96'' provides lubricant for the anti-friction washer 88. The weather cap 106 for the module of FIG. 4 is identical to that of FIG. 2 and is attached to the hold-down nut 60 in the same manner and while it does not protect the plug 144, it does protect the lubricant plug 100 as well as the bolts 40.

Figure 5:
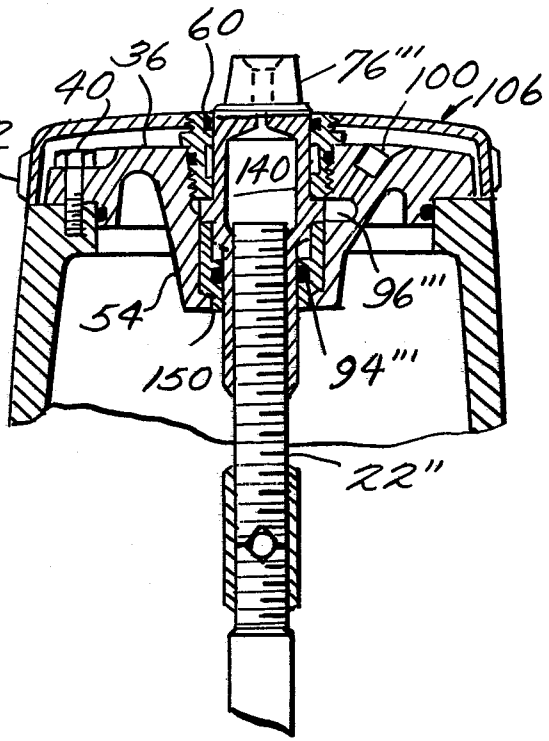
FIG. 5 is a vertical sectional view similar to FIG. 4 but illustrating a still further modified module wherein a bushing is provided between the top closure member and the portion of the operating nut extending downwardly and out of the top closure member.

FIG. 5 discloses a module quite similar to FIG. 4, the only difference being that instead of providing annular seal 94 between the downwardly extending tubular portion 54 and the portion of the operating nut which extends out of the tubular portion 54 of the closure member 36, and an annular bushing is interposed. The annular bushing 150 is preferably made of brass and is provided with an interior annular groove for carrying a sealing ring 94''' for sealing between the portion of the operating nut extending out of the tubular portion 54 and the bushing. The weather cap 106 of the module of FIG. 5 is identical to the weather caps of the modules shown in FIGS. 2, 3 and 4 and likewise it is threaded onto the hold-down nut 60.

All four modules shown respectively in FIGS. 2–5 may be interchanged with one another on the same barrel of a hydrant or any of the modules may be used with any barrel member which has an open upper end and yet all modules will provide the hydrants to which they are attached with a generally flat modern appearance. In each instance once the weather cap is removed all of the modules disclosed may be removed from the valve stems by first removing the bolts 40 and then turning the operating nuts in such a manner as to back the operating nuts off the upper ends of the valve stems.

The terminology used in this specification is for the purpose of description and not limitation, the scope of the invention being defined in the claims.

What is claimed is:

1. A fire hydrant comprising:

a barrel member having an open upper end;

valve means positioned in the lower portion of said barrel member;

a reciprocating valve stem extending from said valve means upwardly within said barrel member;

means operatively engaged between said stem and said barrel member for restraining said stem from rotation while permitting reciprocating movement of the same;

an apertured top closure member detachably secured to the upper end of said barrel member, said closure member having an aperture therethrough with an inwardly extending shoulder therein and including a generally flat plate portion having a diameter great enough to fit on the upper end of said barrel member, a downwardly extending annular portion fitting into the upper end of said barrel member, and a downwardly extending tubular portion for receiving the upper end of said valve stem;

bolt means arcuately spaced about said top closure member detachably securing said top closure member to the upper end of said barrel;

a rotatable operating nut member projecting out of said apertured top closure member and having an exterior flange thereon operatively abutting the shoulder in the aperture of said top closure member;

cooperating thread means on said operating nut member and the upper end of said valve stem whereby said nut member can be rotated to raise and lower said valve stem;

a tubular hold-down nut threadedly received in said apertured top closure member and operatively abutting the exterior flange of said operating nut, said hold-down nut extending out of said top closure member and being exteriorly threaded;

a lubricant reservoir defined between said operating nut and said tubular portion of said top closure member, said flat plate portion having a passage therethrough extending from the exterior to the lubricant reservoir, said passage having a removable plug therein; and, an inverted dish-shaped weather cap having a threaded aperture therethrough, said dish-shaped weather cap having a diameter substantially equal to an outside diameter of the upper end of said barrel member and said weather cap being threaded on to said hold-down nut and protecting said bolt means and said removable plug while giving a flat modern appearance to the hydrant.

2. A fire hydrant as claimed in claim 1 in which said dish-shaped weather cap includes arcuately spaced lugs extending outwardly of the same whereby it may be threaded off of said hold-down nut to provide access to said bolt means and said plug for said reservoir passage.

3. A fire hydrant as claimed in claim 1 including sealing means between said operating nut and said hold-down nut, sealing means between said hold-down nut and said top closure member, and sealing means between said downwardly extending annular portion and the inside of the upper end of said hydrant barrel member.

4. A fire hydrant as claimed in claim 3 in which said sealing means between said downwardly extending annular portion and the inside of the upper end of said hydrant barrel includes an annular interior groove in said tubular portion and a sealing ring in said groove.

5. A fire hydrant as claimed in claim 3 in which said sealing means between said operating nut and said hold-down nut includes an annular interior groove in said hold-down nut and a sealing ring carried in said groove and in which said sealing means between said hold-down nut and said top closure member includes an annular groove defined between the exterior of said hold-down nut and the aperture of said closure member and a sealing ring in said groove.

6. A fire hydrant as claimed in claim 1 in which said operating nut includes a closed bottom bore interiorly threaded and in which the upper end of said valve stem is exteriorly threaded and cooperates with the threads in said closed bottom bore, and including an annular anti-friction washer positioned between the exterior flange on said operating nut and the lower end of said tubular hold-down nut.

7. A fire hydrant as claimed in claim 6 including a sleeve member on the upper end of said valve stem extending from beneath the exterior threads thereon downwardly through and out of the downwardly extending tubular portion of said closure member, sealing means between said downwardly extending tubular portion and said sleeve member and sealing means between the interior of said sleeve member and the exterior of said valve stem.

8. A fire hydrant as claimed in claim 7 wherein said sealing means between said downwardly extending tubular portion and said sleeve member includes at least one annular groove on the interior of said downwardly extending tubular portion and a sealing ring positioned therein and in which said sealing means between the interior of said sleeve member and said valve stem includes an annular groove on the exterior of said valve stem and a sealing ring therein.

9. A fire hydrant as claimed in claim 1 in which said operating nut includes an upper portion projecting through said hold-down nut and having a downwardly opening closed bottom bore therein and a lower portion extending into said closed bottom bore and having the exterior flange thereon, said lower portion below said flange being exteriorly threaded, a thrust bushing positioned between said upper portion and said flange of said lower portion and abutting said inwardly extending shoulder of said closure member and the lower end of said hold-down nut and, in which said valve stem includes a detachable operating screw on its upper end having at least a pair of radially projecting ears thereon, said operating screw being interiorly threaded and receiving the exteriorly threaded lower portion of said operating nut, and in which said downwardly extending tubular portion includes complementary longitudinally extending grooves in its wall defining said lubricant reservoir for receiving the ears of said operating screw of said valve stem causing the said valve stem to move vertically without rotation.

10. A fire hydrant as claimed in claim 9 and including sealing means between the exterior of said operating screw and the lower end of said downwardly extending tubular portion of said closure member.

11. A fire hydrant as claimed in claim 10 in which said operating screw has a closed bottom bore extending upwardly from its lower end and in which another portion of said valve stem is threadedly received in said closed bottom bore and including sealing means between said another portion of said valve stem and said closed bottom bore for protecting the threads of said closed bottom bore and said another portion of said valve stem.

12. A fire hydrant as claimed in claim 1 in which said operating nut includes a closed bottom bore interiorly threaded and in which the upper end of said valve stem is exteriorly threaded and cooperates with the threads in said closed bottom bore, a chamber defined between the upper end of said valve stem and said closed bottom bore and a passageway through said operating nut and communicating from said closed bottom bore to the exterior of said operating nut, said passageway having a plug removably carried therein, whereby said chamber defines a second lubricant reservoir which may be refilled.

13. A fire hydrant as claimed in claim 12 in which said operating nut projects downwardly and outwardly of said downwardly extending tubular portion and including sealing means operatively positioned between the exterior of said operating nut and said downwardly extending tubular portion.

14. A fire hydrant as claimed in claim 13 including an annular bushing carried in the lower end of the downwardly extending tubular portion and said bushing having its upper end abutting said flange.

* * * * *

UNITED STATES PATENT AND TRADEMARK OFFICE

CERTIFICATE OF CORRECTION

PATENT NO. : 4,083,377

DATED : April 11, 1978

INVENTOR(S) : Lawrence F. Luckenbill

It is certified that error appears in the above-identified patent and that said Letters Patent are hereby corrected as shown below:

Column 8, Claim 4,

Line 18, delete "interior".

Line 18, delete "in" and insert --on--.

Line 19, delete "tubular" and insert --annular--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*